United States Patent [19]

Nolte et al.

[11] Patent Number: 4,896,979

[45] Date of Patent: Jan. 30, 1990

[54] DEVICE FOR A PAPER TRANSPORT IN AN OFFICE MACHINE IN PARTICULAR IN A MATRIX PRINTER

[75] Inventors: Gerd Nolte, Senden; Erich Steppe, Ulm, both of Fed. Rep. of Germany

[73] Assignee: Mannesmann AG, Düsseldorf, Fed. Rep. of Germany

[21] Appl. No.: 159,710

[22] Filed: Feb. 24, 1988

[30] Foreign Application Priority Data

Feb. 24, 1987 [DE] Fed. Rep. of Germany ..... 3705856

[51] Int. Cl.[4] ..... B41J 11/50

[52] U.S. Cl. ..... 400/605; 400/616.2; 226/74

[58] Field of Search ..... 400/605, 616.1, 616.2; 226/196, 74, 70, 181, 183, 52

[56] References Cited

U.S. PATENT DOCUMENTS

| | | | |
|---|---|---|---|
| 4,440,516 | 4/1984 | Rosenthal et al. | 400/616.1 |
| 4,571,103 | 2/1986 | Takeo et al. | 400/616.2 |
| 4,572,419 | 2/1986 | Hirata | 400/616.2 |
| 4,662,767 | 5/1987 | Pimintel | 400/616.2 |
| 4,742,946 | 5/1988 | Hamamichi et al. | 400/605 X |

FOREIGN PATENT DOCUMENTS

| | | | |
|---|---|---|---|
| 29569 | 2/1906 | Japan | 400/616.2 |
| 205182 | 12/1982 | Japan | 400/616.2 |
| 161175 | 9/1985 | Japan | 400/616.2 |
| 84263 | 4/1986 | Japan | 400/616.2 |

*Primary Examiner*—William Pieprz
*Assistant Examiner*—James R. McDaniel
*Attorney, Agent, or Firm*—Horst M. Kasper

[57] ABSTRACT

A device for a paper transport in an office machine, in particular in a matrix printer, presupposes the presence of side plates (1, 2), wherein a print-support surface (7) is supported and, in addition, a friction drive including a roller pair for individual sheets (9) to be transported or, respectively, endless webs (10) without edge perforation, and tractors (13) provided in pairs, which operate in push and pull operation. In order to provide a universal paper transport device for different kinds of paper, where the respective paper type is held ready, it is disclosed that the tractor pair (**14*a*, 14*b*) can be driven with a tractor gear wheel (21) fixed against rotation on the tractor shaft (17), which tractor gear wheel (21) can be put in a force-transmitting connection with the paper drive motor (22) and where the tractor pair (14*a*, 14*b*) can be tilted with a lever drive (31) relative to the paper guide plane (32) in each case into an about tangential direction (33) relative to the circumferential upper side (36) or to the circumferential lower side (34) of the print-support surface (7**).

20 Claims, 2 Drawing Sheets

DEVICE FOR A PAPER TRANSPORT IN AN OFFICE MACHINE IN PARTICULAR IN A MATRIX PRINTER

BACKGROUND OF THE INVENTION

1. Field of the Invention

The invention relates to a device for the paper transport in an office machine, in particular in a matrix printer, with a print-support surface supported in side plates for individual sheets or, respectively, endless webs transportable with a friction drive, as well as for edge-perforated endless webs with tractors provided in pairs in a pull or push operation.

2. Brief Description of the Background of the Invention Including Prior Art

Such paper transport devices are essentially required for two, in general differing, kinds of paper. On the one hand, individual sheets or, respectively, endless webs without perforation are transported and, on the other hand, tractors are employed which, as their name indicates, operate in pull operation and are provided as mounting devices. Depending on whether the operation is with individual sheets, i.e. non-perforated endless webs, or with edge-perforated endless webs, correspondingly, a special device for the transport of the paper is required.

The use of a friction drive with a print roller pair or of a tractor with a tractor pair depends further on whether the print-support surface is provided as a print roller or as a spatially fixedly disposed print bar.

It is known from the U.S. Pat. No. 2,140,028 to provide both a friction drive as well as tractors for a paper transport device. The known device however does not allow to employ the tractor, in addition to the pull operation, also for the push operation. This means that the conventional device is not simultaneously suitable for several kinds of paper. Under "simultaneously suitable" is understood in this context that an operation with differing kinds of papers can be performed in an advantageous way where, respectively, one or the other kind of paper is available in a waiting position, i.e. placed in the paper transport device.

SUMMARY OF THE INVENTION

1. Purposes of the Invention

It is an object of the present invention to provide a paper transport device for individual sheets, for unperforated paper webs, and for edge-perforated paper webs, which allows to place the different papers into print position by a selection and changeover setting mechanism.

It is a further object of the present invention to provide a drive which allows to feed paper to a matrix printer from different paper storage bins.

It is yet another object of the invention to furnish a matrix printer transport device, which allows to switch between different kinds of paper by a simple lever operation.

These and other objects and advantages of the present invention will become evident from the description which follows.

2. Brief Description of the Invention

A device for paper transport in an office machine comprises side plates, a print support surface supported by the side plates, a paper drive motor, and a tractor shaft supported by the side plates. Furthermore, a tractor gear wheel is fixed against rotation on the tractor shaft. Transmission means are associated with the paper drive motor for placing the tractor gear wheel into and out of a force-transmission connection with the paper drive motor. A tractor pair is force-transmittingly connected to the tractor gear wheel. A lever drive is included for tilting the tractor pair relative to the paper guide plane in each case into an about tangential direction relative to the circumferential upper side or relative to the circumferential lower side of the print support surface.

Input means for individual sheets or, respectively, endless webs, can be transportable with a friction drive. Tractors can be provided in pairs in pull or push operation for edge-perforated endless webs.

The lever drive can comprise a two-armed hand lever tiltably supported at one of the side plates having a first and a second lever arm. A rocker lever can be provided at the second lever arm of the two-armed hand lever. A connecting link guide can be provided at the rocker lever. A link block can be fixedly disposed in the side plate for engaging the connecting link guide. A cam curve guide formed at the tractor pair can rest at the rocker lever. The connecting link guide in the rocker lever can consist of an about angular shaped hole. Preferably, the connecting link guide extends substantially in the direction of the rocker lever, where the connecting link guide is formed such that the middle of the connecting link guide and the ends of the connecting link guide are disposed in opposite rotation directions of the rocker lever.

An idler gear wheel can selectively engage the tractor gear wheel of the tiltable tractor pair. An idler gear wheel can engage the tractor gear wheel and the tractor gear wheel and the idler gear wheel can be rotary supported in a side wall containing a curve guide. A curve guide for the tractor pair including a curve plate can form the side wall.

An idler wheel can engage the tractor wheel and move together with the tractor wheel such as to allow alternation of engagement of a pinion between tractor wheel and idler wheel and to coordinate a simultaneous shift of the paper tangential output direction of the tractor entailed in the same motion allowing a change in paper supply without manual paper bin change.

Preferably, an idler wheel and tractor wheel motion direction is a motion tangential within an angle of 30 degrees relative to the rocker motion tangential direction at a respective radius. The diameter of the pinion can be from about 0.2 to 0.5 times the radius of the idler wheel.

A slider can run in parallel to the cross-direction of the paper to be transported. A matrix print head, disposed on the slider for printing on the paper, can be supported by the print support surface and moved by the tractors.

A method for transporting paper in an office machine wherein the office machine includes side plates, a print-support surface supported by the side plates, a paper drive motor, a tractor shaft supported by the side plates, and tractor gear wheel fixed against rotation on the tractor shaft, comprises the steps of tilting the tractor pair relative to the paper guide plane with a lever drive in each case into an about tangential direction relative to the circumferential upper side or relative to the circumferential lower side of the print support surface. Furthermore, the tractor gear wheel is placed into and out of a force-transmitting connection with the paper drive motor by way of transmission means associated with the paper drive motor. An idler wheel engaging the tractor gear wheel is placed into and out of a force-transmitting connection with the paper drive motor by way of transmission means associated with the paper drive motor such that the tractor wheel is driven either directly or via the idler wheel by the paper drive motor. The drive force is transmitted from the tractor gear wheel to a tractor pair.

The method for transporting paper in an office machine can further comprise the step of actuating the hand lever for changing the paper guide plane. For this purpose, the office machine can include a two-armed hand lever tiltably supported at one of the side plates having a first and a second lever arm. Furthermore, a rocker lever can be provided at the second lever arm of the two-armed hand lever and a connecting link guide can be provided at the rocker lever. A link block can be fixedly disposed in the side plate for engaging the connecting link guide. A cam curve guide formed at the tractor can rest at the rocker lever.

According to the invention, the tractor pair can be driven with a tractor gear wheel rotatably fixedly disposed at a tractor shaft. The tractor gear wheel can be placed in a force-transmitting engagement with the paper drive motor and the tractor pair can be tilted with a lever drive relative to the paper guide plane, in each case, into an about tangential direction relative to the circumferential upper side or to the circumferential lower side of the print-support surface. Such a paper transport device initially allows a push or pull operation of the provided tractors. Advantageously, the push operation can be set by tilting of the tractor pair at the lower side of the print-support surface, and the push operation can be set by tilting of the tractor pair at the upper side of the print-support surface where, advantageously, the corresponding drive connection is created simultaneously. On the other hand, the tractor pair can also be decoupled from a drive by tilting.

According to a feature of the invention, it is provided that the lever drive comprises a two-armed hand lever, tiltably supported at the side plate, where a rocking lever with a connecting link guide for a link block is provided at the second lever arm of the two-armed hand lever, where the link block is fixedly disposed in the side plate and where a curve guide of the tractor guide rests on the rocking lever. This results in a substantial positive control upon tilting of the tractor pair.

A further improvement of the invention provides that the tiltable tractor pair exhibits, in addition to the tractor gear wheel, an idler gear wheel engaging the tractor gear wheel. The idler gear wheel is advantageously employed for reversing the rotation direction of the paper drive upon switching from push to pull operation.

Other features of the invention comprise that the tractor gear wheel and the respective idler gear wheel are rotatably supported in a side wall exhibiting the curve guide. This feature serves to minimize the equipment requirements in order to achieve tiltability of the tractor pair.

A further feature of the invention includes that the curve guide for the tractor pair is furnished as a curve plate forming the side wall. While the side wall already receives the rotary supports for the tractor gear wheel and the idler gear wheel, now, in addition, the curve guide is placed at the same time on this side wall, by forming the side wall as a curve plate. Therefore, this curve plate serves for the control of the tilting motion of the tractor pair.

Furthermore, it is provided that the connecting link guide in the rocker lever consists of an about angular hole. Preferably, the motions of the tractors can be controlled by the shape of this hole.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
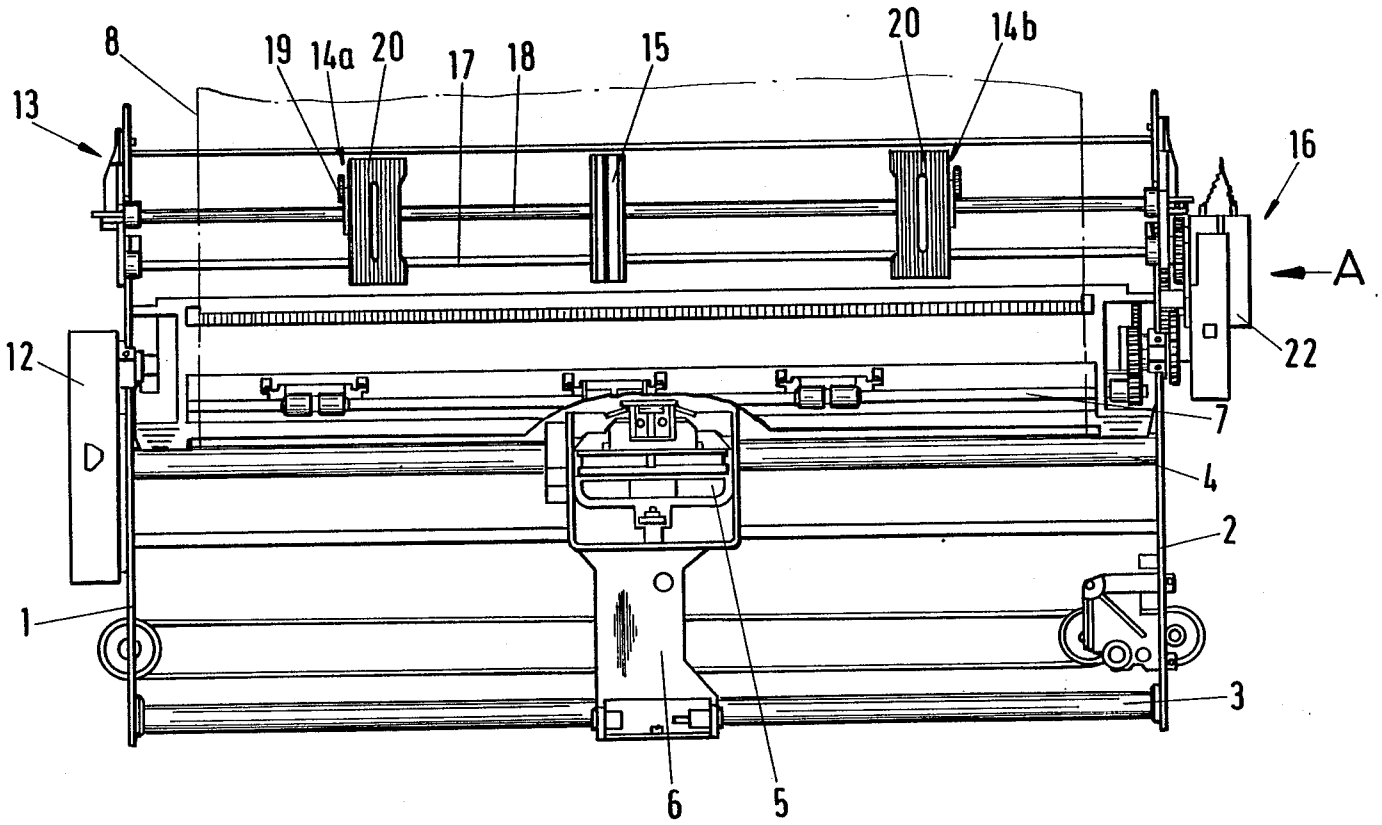
FIG. 1 is a schematic top planar view of an application example of a matrix printer without the usually employed printer casing.

In a device for paper transport in an office machine, in particular a matrix printer, a print-support surface is disposed in side plates for individual sheets or, respectively, endless webs, transportable with a friction drive, as well as with tractors provided in pairs in pull or push operation for edge-perforated endless webs. The tractor pair **14*a*, 14*b* is drivable with a tractor gear wheel 21 fixed against rotation on the tractor shaft 17. The tractor gear wheel 21 can be placed into and out of a force-transmitting connection with the paper drive motor 22. The tractor pair 14*a*, 14*b* can be tilted with a lever drive 31, relative to the paper guide plane 32 in each case in an about tangential direction 33 to the circumferential upper side 36 or the circumferential lower side 34 of the print-support surface 7**.

The lever drive 31 can comprise a two-armed hand lever 26 tiltably supported at one of the side plates 2. At the second lever arm **26*a* of the two-armed hand lever 26 there can be provided a rocker lever 27 with a connecting link guide 28 for a link block 29. The link block 29 can be fixedly disposed in the side plate 2. A curve guide 30 of the tractor pair 14*a*, 14*b* can rest at the rocker lever 27**.

The tiltable tractor pair **14*a*, 14*b* can exhibit in addition to the tractor gear wheel 21 an idler gear wheel 37 engaging the tractor gear wheel 21. The tractor gear wheel 21 and the respective idler gear wheel 37 can be rotary supported in a side wall 38 containing a curve guide 30. The curve guide 30 for the tractor pair 14*a*, 14*b* can comprise a curve plate 39 forming the side wall 38**.

The connecting link guide 28 in the rocker lever 27 can consist of an about angular shaped hole 40.

The matrix printer according to FIG. 1 comprises two side plates 1 and 2. The side plates 1 and 2 are connected to each other by slider guide axles 3 and 4.

The print head slider 6, supporting the matrix print head 5, is moved back and forth by a special slide drive. In addition, a print-support surface 7 is attached in the side plates 1 and 2. A recorder carrier 8, comprising an individual sheet 9, an endless web 10, with or without edge perforation, or an edge-perforated endless web 11, rests on the print-support surface 7 ready for printing.

The print head slider 6 can be placed at the proper distance relative to an ink ribbon and to the recording carrier 8 with a print head distance setting device 12. A tractor device group 13 is disposed behind the print support surface 7. The tractor device group 13 includes two tractors 14*a* and 14*b* as well as a paper support 15.

The device 16 for the paper transport is disposed in the right rear region of the matrix printer. The tractors 14*a* and 14*b* are disposed on a tractor shaft 17 and are laterally adjustable on a D axle 18 and fixed in position with the aid of eccentric levers 19. Each of the tractors 14*a*, 14*b* is furnished with a tractor flap 20, under which tractor flap 20 the edge-perforated endless web 11 is guided.

Figure 2:
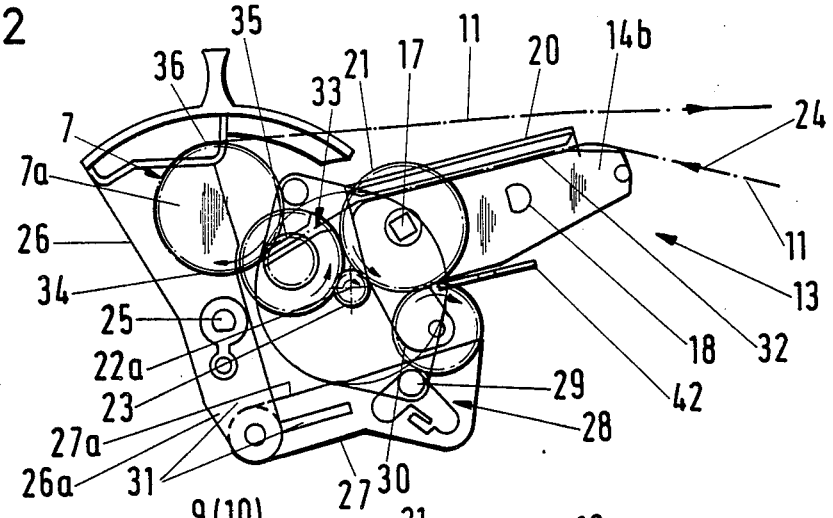
FIG. 2 is a side view of the building group relevant to the invention seen in direction A, as designated in FIG. 1, in an enlarged scale in a first operating position.

A first operation position is illustrated in FIG. 2. A pivotally fixed tractor gear wheel 21 is coordinated to the tractor pair 14*a*, 14*b* on the tractor shaft 17. A pinion 23, which engages into the tractor gear wheel 21, is disposed at a shaft 22*a* of a paper drive motor 22. In this context, the rotary direction of the pinion 23 is selected such that the tractor shaft 17 is driven in push direction 24. The tractor pair 14*a*, 14*b* also operates in push operation in this case. The position of the individual device elements is determined in this case as follows: a two-armed hand lever 26 is sitting on a second D axle 25, which is pivotally borne supported in the side plate 2. A rocker lever 27 is hinged on one lever arm 26*a* of the two-armed hand lever 26. The rocker lever 27 is provided with a connecting link guide 28 for a link block 29, where the link block 29 is rigidly attached in the side plate 2. A curve guide 30 for the tractor pair 14*a*, 14*b* rests at a straight and planar cutter-like edge 27*a* of the rocker lever 27.

The hand lever 26, the lever arm 26*a* of the hand lever 26, the rocker lever 27, the edge 27*a*, and the curve guide 30 form the lever drive 31.

In a first operating position according to FIG. 2, the paper guide plane 32 runs in an about a tangential direction 33 relative to the circumferential lower side 34 of the print-support surface 7 formed as a print roller 7*a*. Therefore, the tractor pair 14*a*, 14*b* shifts the edge-perforated endless webs 11 about tangential at the circumferential lower side 34 through a guide channel 35 and, if required, past further press-on rollers, not illustrated here, along a tangential direction at the circumferential upper side 36 again out of the matrix printer. The first operating position thus connects the push operation with an edge-perforated endless web 11.

Figure 3:
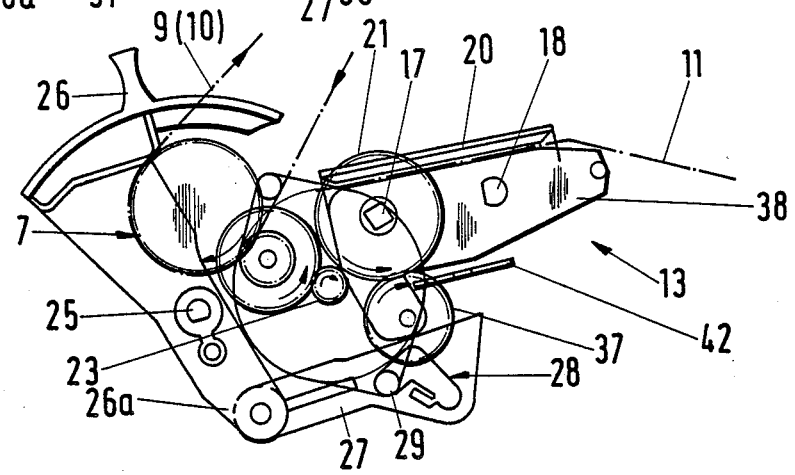
FIG. 3 is a side view according to FIG. 2 in a second operating position.

According to a second operating position illustrated in FIG. 3, the hand lever 26 is in a position tilted toward the left relative to a vertical position such that the lever arm 26*a* lifts up the rocker lever 27 as guided in the connecting link guide 28 by the link block 29. The higher positioning is determined by the connecting link guide 28. This higher positioning brings the tractor gear wheel 21 out of engagement with the pinion 23 such that the tractor shaft 17 is no longer driven. Nevertheless, the edge-perforated endless web 11 can be kept ready and can be brought into print position after discharging of the individual sheet 9 or, respectively, of an endless web 10, with or without edge perforation.

The tiltable tractor pair 14*a*, 14*b* exhibits, in addition to the tractor gear wheel 21, an idler gear wheel 37 engaging the tractor gear wheel 21. The idler gear wheel 37 is pivotally borne in a side wall 38 provided with a curve guide 30. The side wall 38 is formed in this case as a curve plate 39, i.e. it carries simultaneously the curve guide 30 at the outer circumference.

Figure 4:
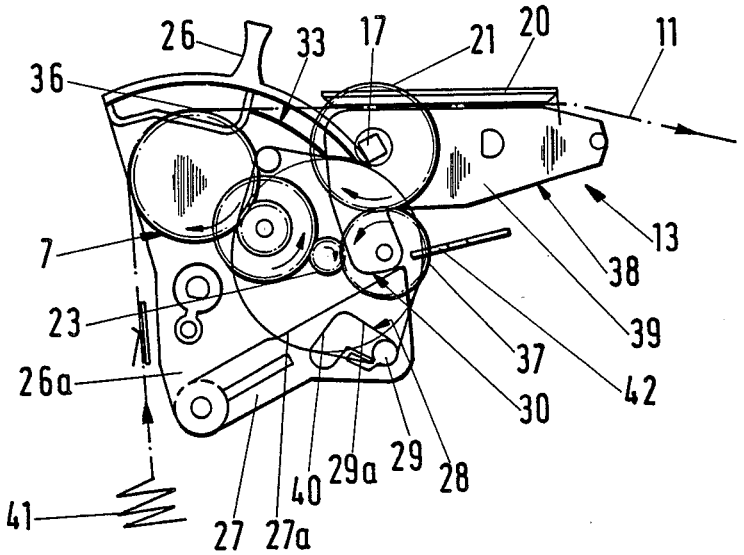
FIG. 4 is a side view according to FIG. 2 in a third operating position.

According to a third operating position, illustrated in FIG. 4, the hand lever 6 is now tilted out of the vertical position toward the right side. The connecting link guide 28 in the rocker lever 27 comprises in addition an about angle-shaped hole 40. The link block 29 passes into the other branch 29*a* of the connecting link guide 28 by tilting of the hand lever 26, whereby the lever arm 26*a* places the rocker lever 27 in a very high position such that the edge 27*a* markedly lifts up the curve guide 30 of the tractor pair 14*a*, 14*b*. In this context, the idler gear wheel 37 passes into engagement with the pinions 23, drive the idler gear wheel 37 and the tractor gear wheel 21 and thus rotates the tractor shaft 17. The rotation pulls the edge-perforated endless web 11 out of a paper storage bin 41 around the print-support surface 7, whereby the tractor pair 14*a*, 14*b* operates in a pull operation and where the tractor pair 14*a*, 14*b* is tilted into the tangential direction 33 relative to the circumferential upper side 36 of the print-support surface 7. At the same time, the rotary direction of the tractor gear wheel 21 is set to pull by pinion 23, always rotating in the same direction, with the idler gear wheel 37. In this position, the tractor pair 14*a*, 14*b* is disposed at a substantial distance from a detent 42 in contrast to the first operating position illustrated in FIG. 1 or FIG. 2. Each one of the three operating positions can also be provided with a locking engagement supported in place by spring force.

The print support surface preferably overlaps the hand lever 26 as seen in a projection on the plane which, in projection, defines the paper advance motion. The length of the rocker lever 27 is about two to three times the distance of the hinge point of the rocker lever on the hand lever from the tilting axis of the hand lever. The edge of the rocker lever engaging the cam curve guide 30 is preferably substantially a straight line and the cam curve guide is rounded. The engagement of the cam curve guide and of the rocker lever occurs in the half area of the idler gear wheel remote from the tractor. The link connection guide is preferably provided with two locking positions corresponding to the two positions of the tractor. Alternatively, it is possible that the rocker lever carries a link block and that a link connection guide hole is furnished at the frame.

It will be understood that each of the elements described above, or two or more together, may also find a useful application in other types of paper transport devices differing from the types described above.

While the invention has been illustrated and described as embodied in the context of device for a paper transport in an office machine and, in particular, in a matrix printer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for paper transport in an office machine comprising side plates;

a print support surface supported by the side plates, a paper drive motor;

a tractor shaft supported by the side plates;

a tractor gear wheel fixed against rotation on the tractor shaft; transmission means associated with the paper drive motor for placing the tractor gear wheel into and out of a force-transmitting connection with the paper drive motor;

a tractor pair force-transmittingly connected to the tractor gear wheel;

a lever drive for tilting the tractor pair relative to the paper guide plane in each case into an about tangential direction relative to the circumferential upper side or relative to the circumferential lower side of the print support surface;

an idler wheel engaging the tractor wheel for reversal of the rotary direction of motion of the tractor wheel and moving together with the tractor wheel such as to allow alternation of engagement of a pinion between tractor wheel and idler wheel and to coordinate a simultaneous shift of the paper tangential output direction of the tractor entailed in the same motion for a change in paper supply without manual paper bin change.

2. The device for paper transport according to claim 1 further comprising input means for individual sheets or, respectively, endless webs, transportable with a friction drive; tractors provided in pairs in pull or push operation for edge-perforated endless webs.

3. The device for paperr transport according to claim 1 wherein the lever drive comprises a two-armed hand lever tiltably supported at one of the side plates having a first and a second lever arm;

a rocker lever provided at the second lever arm of the two-armed hand lever;

a connecting link guide provided at the rocker lever;

a link block is fixedly disposed in the side plate for engaging the connecting link guide;

a cam curve guide formed at the tractor pair resting at the rocker lever.

4. The device for paper transport according to claim 3 wherein the connecting link guide in the rocker lever consists of an opening shaped about like an angled two arm lever.

5. The device for paper transport according to claim 3 wherein the connecting link guide extends substantially in the direction of the rocker lever, where the connecting link guide is formed such that the middle of the connecting link guide and the ends of the connecting link guide are disposed in opposite rotation directions of the rocker lever.

6. The device for paper transport according to claim 1 further comprising an idler gear wheel selectively engaging the tractor gear wheel of the tiltable tractor pair.

7. The device for paper transport according to claim 1 further comprising an idler gear wheel for engaging the tractor gear wheel and wherein the tractor gear wheel and the idler gear wheel are rotary supported in a side wall containing a curve guide.

8. The device for paper transport according to claim 1 further comprising a curve guide for the tractor pair including a curve plate forming the side wall.

9. The device for paper transport according to claim 1 further comprising a slider running in parallel to the cross-direction of the paper to be transported;

a matrix print head disposed on the slider for printing on the paper supported by the print support surface and moved by the tractors.

10. The device for paper transport according to claim 1 further comprising input means for individual sheets or, respectively, endless webs, transportable with a friction drive; tractors provided in pairs in pull or push operation for edge-perforated endless webs; wherein the lever drive comprises a two-armed hand lever tiltably supported at one of the side plates having a first and a second lever arm;

a rocker lever provided at the second lever arm of the two-armed hand lever;

a connecting link guide provided at the rocker lever; a link block is fixedly disposed in the side plate for engaging the connecting link guide;

a cam curve guide formed at the tractor pair resting at the rocker lever; wherein the connecting link guide in the rocker lever consists of an about angular shaped recess;

wherein the connecting link guide extends substantially in the direction of the rocker lever, where the connecting link guide is formed such that the middle of the connecting link guide and the ends of the connecting link guide are disposed in opposite rotation directions of the rocker lever;

wherein the idler gear wheel selectively engages the tractor gear wheel of the tiltable tractor pair and wherein the tractor gear wheel and the idler gear wheel are rotary supported in a side wall containing a curve guide;

a curve guide for the tractor pair including a curve plate forming the side wall;

wherein the idler wheel and tractor wheel motion direction is a motion tangential within an angle of 30 degrees relative to the rocker motion tangential direction at a respective radius and wherein the diameter of the pinion is from about 0.2 to 0.5 times the radius of the idler wheel; a slider running in parallel to the cross-direction of the paper to be transported;

a matrix print head disposed on the slider for printing on the paper supported by the print support surface and moved by the tractors.

11. Device for paper transport in an office machine, in particular a matrix printer, with a print-support surface, disposed in side plates, for individual sheets or, respectively, endless webs, transportable with a friction drive, as well as with tractors provided in pairs in pull or push operation for edge-perforated endless webs, wherein the tractor pair (14*a*, 14*b*) is drivable with a tractor gear wheel (21) fixed against rotation on the tractor shaft (17), which tractor gear wheel (21) can be placed into and out of a force-transmitting direct contacting connection with a paper drive motor shaft gear (22), and where the tractor pair (14*a*, 14*b*) can be tilted with a lever drive (31), relative to the paper guide plane (32) in each case in an about tangential direction (33) to the circumferential upper side (36) or to the circumferential lower side (34) of the print-support surface (7), wherein the tiltable tractor pair (14*a*, 14*b*) exhibits in addition to the tractor gear wheel (21) an idler gear wheel (37) for alternatively directly engaging the tractor gear wheel (21) and the paper drive motor shaft gear while the tractor gear wheel is out of the force transmitting direct connection with the paper drive motor shaft gear and for reversal of rotary direction of motion of the tractor gear wheel relative to rotary direction resulting from the direction connection of the tractor gear wheel to the paper drive motor shaft gear.

12. Device for paper transport according to claim 1 wherein an idler wheel engages the tractor wheel and moves together with the tractor wheel such as to allow alternation of engagement of a pinion between tractor wheel and idler wheel and to coordinate a simultaneous shift of the paper tangential output direction of the tractor entailed in the same motion for a change in paper supply without manual paper bin change.

13. The device for paper transport according to claim 12 wherein an idler wheel and tractor wheel motion direction is a motion tangential within an angle of 30 degrees relative to the rocker motion tangential direction at a respective radius and wherein the diameter of the pinion is from about 0.2 to 0.5 times the radius of the idler wheel.

14. Device according to claim 12, wherein the lever drive (31) comprises a two-armed hand lever (26) tiltably supported at one of the side plates (2), where at the second lever arm (26*a*) of the two-armed hand lever (26) there is provided a rocker lever (27) with a connecting link guide (28) for a link block (29), where the link block (29) is fixedly disposed in the side plate (2) and where a curve guide (30) of the tractor pair (14*a*, 14*b*) rests at the rocker lever (27).

15. Device according to claim 11, wherein the tractor gear wheel (21) and the respective idler gear wheel (37) are rotary supported in a side wall (38) containing a curve guide (30).

16. Device according to claim 11, wherein the curve guide (30) for the tractor pair (14*a*, 14*b*) comprises a curve plate (39) forming the side wall (38).

17. Device according to claim 11, wherein the connecting link guide (28) in the rocker lever (27) consists of an opening (40) shaped like an angled two arm lever.

18. Device according to claim 11, wherein the lever drive (31) comprises a two-armed hand lever (26) tiltably supported at one of the side plates (2), where at the second lever arm (26*a*) of the two-armed hand lever (26) there is provided a rocker lever (27) with a connecting link guide (28) for a link block (29), where the link block (29) is fixedly disposed in the side plate (2) and where a curve guide (30) of the tractor pair (14*a*, 14*b*) rests at the rocker lever (27);

wherein the tractor gear wheel (21) and the respective idler gear wheel (37) are rotary supported in a side wall (38) containing a curve guide (30);

wherein the curve guide (30) for the tractor pair (14*a*, 14*b*) comprises a curve plate (39) forming the side wall (38);

wherein the connecting link guide (28) in the rocker lever (27) consists of an opening (40) shaped like an angled two arm lever.

19. A method for transporting paper in an office machine wherein the office machine includes side plates;

a print support surface supported by the side plates, a paper drive motor;

a tractor shaft supported by the side plates;

a tractor gear wheel fixed against rotation on the tractor shaft;

comprising the steps of tilting the tractor pair relative to the paper guide plane with a lever drive in each case into an about tangential direction relative to the circumferential upper side or relative to the circumferential lower side of the print support surface;

placing the tractor gear wheel into and out of a force-transmitting direct connection with the paper drive motor by way of transmission means associated with the paper drive motor;

placing an idler wheel engaging the tractor gear wheel into and out of a force-transmitting direct connection with the paper drive motor by way of transmission means associated with the paper drive motor such that the tractor wheel is driven either directly or via the idler wheel by the paper drive motor;

transmitting the drive force from the tractor gear wheel to a tractor pair.

20. The method for transporting paper in an office machine according to claim 19, wherein the office machine includes further a two-armed hand lever tiltably supported at one of the side plates having a first and a second lever arm;

a rocker lever provided at the second lever arm of the two-armed hand lever;

a connecting link guide provided at the rocker lever;

a link block fixedly disposed in the side plate for engaging the connecting link guide;

a cam curve guide formed at the tractor pair resting at the rocker lever, further comprising the step of actuating the hand lever for changing the paper guide plane.

* * * * *